US005952591A

United States Patent [19]

Thurman

[11] Patent Number: 5,952,591

[45] Date of Patent: Sep. 14, 1999

[54] STRINGED MUSICAL INSTRUMENTS HAVING THREE DIMENSIONAL SOUND HOLES

[76] Inventor: Roger G. Thurman, 904 Franklin Ave., Kent, Ohio 44240

[21] Appl. No.: 08/786,888

[22] Filed: Jan. 23, 1997

[51] Int. Cl.[6] ..... G10D 1/08

[52] U.S. Cl. ..... 84/267; 84/291

[58] Field of Search ..... 84/291, 292, 294, 84/267, 268, 269, 290; D17/14, 19

[56] References Cited

U.S. PATENT DOCUMENTS

| | | | |
|---|---|---|---|
| 734,802 | 7/1903 | Blair | 84/268 |
| 775,658 | 11/1904 | Isbell | 84/268 |
| 3,474,697 | 10/1969 | Kaman | 84/267 |
| 3,894,464 | 7/1975 | Brooks | 84/327 |
| 3,974,730 | 8/1976 | Adams, Jr. | 84/291 |
| 4,242,938 | 1/1981 | Van Zalinge | 84/1.16 |
| 4,317,402 | 3/1982 | McPherson, Sr. | 84/291 |
| 4,467,692 | 8/1984 | Egan | 84/291 |
| 4,903,567 | 2/1990 | Justus | 84/294 |
| 5,567,896 | 10/1996 | Gottschall | 84/294 |
| 5,841,047 | 11/1998 | Mandreck | 84/274 |

*Primary Examiner*—William M. Shoop, Jr.
*Assistant Examiner*—Kim Lockett
*Attorney, Agent, or Firm*—Oldham & Oldham Co., L.P.A.

[57] ABSTRACT

Stringed musical instruments having three dimensional sound holes generally including a body portion having a top member known as a soundboard, side walls extending substantially perpendicular to the soundboard around the perimeter of the sound board and a back member substantially corresponding in shape and dimensions to the soundboard attached to the surface of the side walls distal to the soundboard to form an enclosed sound chamber. Stringed musical instruments having three dimensional sound holes further include a neck portion extending outwardly from the soundboard and the corresponding side wall, the neck portion preferably bilaterally dissecting the soundboard of the stringed musical instruments. In accordance with preferred embodiments of the present invention, sound holes are provided which extend through both a portion of the soundboard and/or the back member, as well as through at least a portion of the adjacent side wall, to provide enhanced tonal quality and/or enhanced volume of the sound emanating from the stringed musical instrument when played.

20 Claims, 3 Drawing Sheets

STRINGED MUSICAL INSTRUMENTS HAVING THREE DIMENSIONAL SOUND HOLES

BACKGROUND AND SUMMARY OF THE INVENTION

The present invention relates generally to new and novel stringed musical instruments having three dimensional sound holes. More particularly, the present invention relates to new and novel stringed musical instruments, such as guitars, violins, violas, cellos, string basses, mandolins, autoharps, ukuleles, dulcimers and others, which have three dimensional sound holes to enhance the tonal quality and/or volume of sound emanating from such stringed musical instruments.

Stringed musical instruments are typically constructed of an top member known as a soundboard, side walls which descend at substantially a right angle around the perimeter of the soundboard and a back member which has substantially the same shape and dimensions as the soundboard and which is attached to the surface of the side walls distal from the soundboard to form an enclosed sound chamber. A neck member extends outwardly from the top of the soundboard and corresponding side walls and the neck member is typically positioned to bilaterally dissect the soundboard of the stringed musical instruments.

In the field of designing and manufacturing stringed musical instruments, it is a continuing objective to provide stringed musical instruments having richer or improved tonal sound quality. In addition, providing stringed musical instruments having enhanced volume of sound is generally desirable, particularly in the case of guitars and string basses. A significant disadvantage of prior art stringed musical instruments is the manner in which the audible portion, including the tonal quality and loudness or volume of sound waves emanating from the stringed musical instrument, can be heard by the human ear. Traditionally, sound or "f" holes are provided as the primary means for facilitating the emission of sound waves from the sound chamber of such stringed musical instruments. Prior art stringed musical instruments typically incorporate traditional sound or "f" holes which are positioned at various locations upon the soundboard of such stringed musical instruments. For example, guitars have typically incorporated a single circular sound hole or a series of sound or "f" holes having various geometric configurations. Such prior art sound or "f" holes have traditionally been positioned either alone or in multiple numbers on the soundboard of the stringed musical instrument. However, to applicant's knowledge, no prior art stringed musical instrument has incorporated sound holes which extend through both the soundboard, as well as an adjacent side wall of the stringed musical instruments.

Accordingly, an object of the present invention is the provision of stringed musical instruments having three dimensional sound holes which provide enhanced tonal quality of the sound emanating from the stringed musical instruments when played.

Another object of the present invention is the provision of stringed musical instruments having three dimensional sound holes which provide enhanced volume of sound emanating from the stringed musical instruments when played.

Yet another object of the present invention is the provision of stringed musical instruments having three dimensional sound holes which provide both enhanced tonal quality, as well as enhanced volume of sound, emanating from the stringed musical instruments when played.

These and other objects of the present invention are attained by the provision of stringed musical instruments having three dimensional sound holes generally including a body portion having a top member known as a soundboard, side walls extending substantially perpendicular to the soundboard around the perimeter of the soundboard and a back member substantially corresponding in shape and dimensions to the soundboard attached to the surface of the side walls distal to the soundboard to form an enclosed sound chamber. Stringed musical instruments having three dimensional sound holes further include a neck portion extending outwardly from the soundboard and the corresponding side wall, the neck portion preferably bilaterally dissecting the soundboard of the stringed musical instruments. In accordance with preferred embodiments of the present invention, sound holes are provided which extend through a portion of the soundboard and/or the back member, as well as through at least a portion of the adjacent side wall, to provide enhanced tonal quality and/or enhanced volume of the sound emanating from the stringed musical instruments when played.

Other advantages and novel features of the present invention will become apparent in the following detailed description of the invention when considered in conjunction with the accompanying drawings.

DETAILED DESCRIPTION OF THE DRAWINGS

Figure 1:
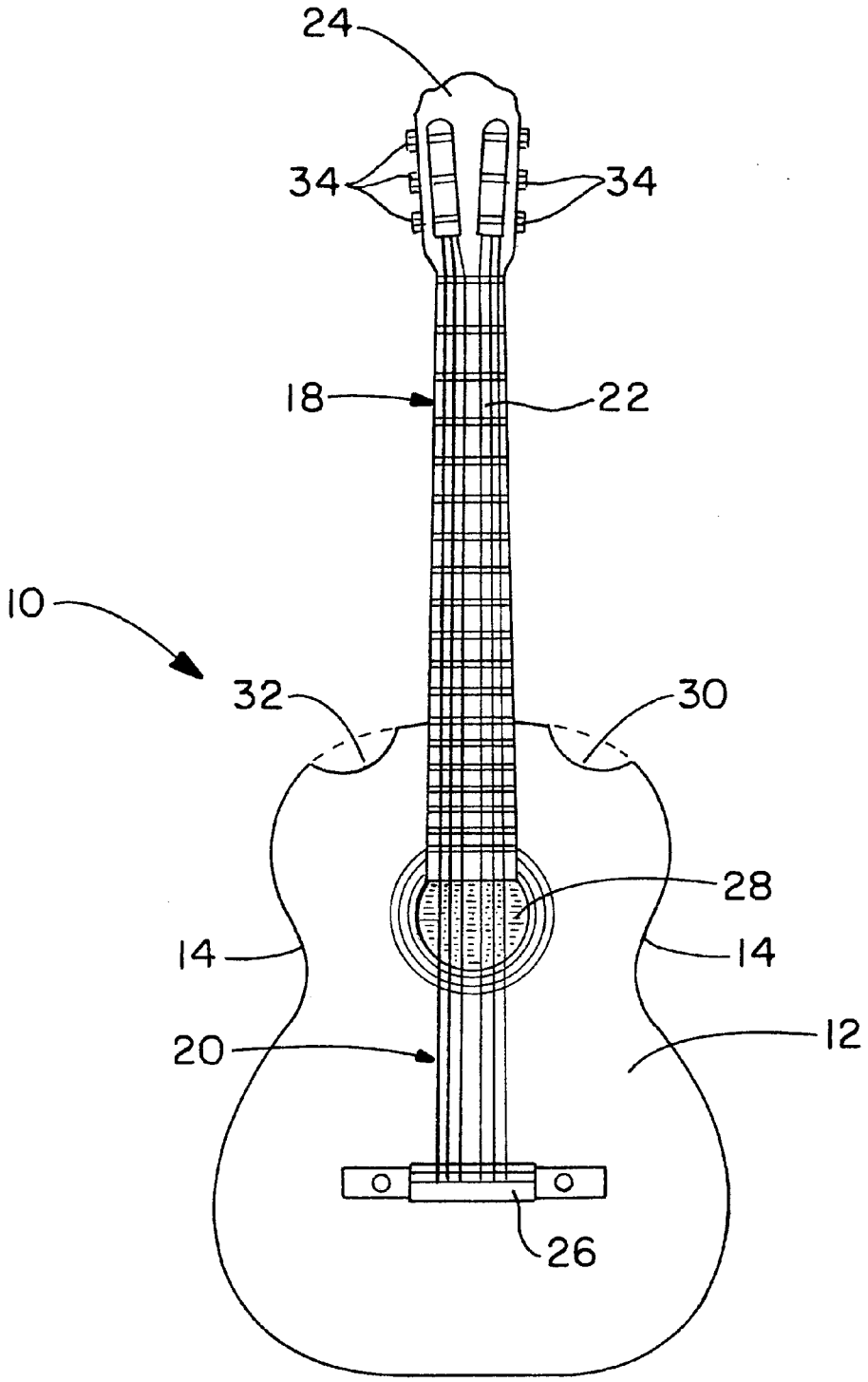
FIG. 1 illustrates a front elevational view of a stringed musical instrument having three dimensional sound holes in accordance with a first preferred embodiment of the present invention.
Figure 2:
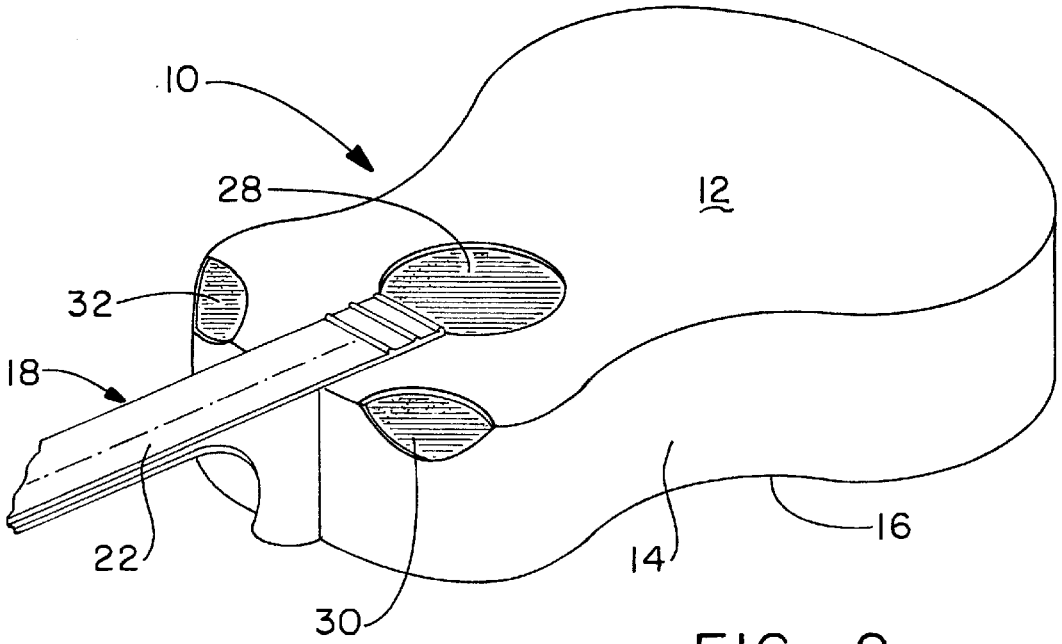
FIG. 2 illustrates a front perspective view of the stringed musical instrument having three dimensional sound holes in accordance with the first preferred embodiment of the present invention shown in FIG. 1.

In the following detailed description of preferred embodiments of the present invention, reference is made to the accompanying drawings which, in conjunction with this detailed description, illustrate and describe several preferred embodiments of a stringed musical instrument having three dimensional sound holes in accordance with the present invention. Referring first to FIGS. 1 and 2, which illustrate a front elevational view and a front perspective view, respectively, of a stringed musical instrument having three dimensional sound holes, generally identified by reference number 10, in accordance with a first preferred embodiment of the present invention, stringed musical instrument 10 generally includes top member or soundboard 12, side walls 14 which extend from soundboard 12 at substantially a right angle around the perimeter of soundboard 12 and back member 16 which preferably has substantially the same shape and dimensions as soundboard 12, back member 16 being attached to the surface of side walls 14 distal from soundboard 12 to form an enclosed sound chamber. Stringed musical instrument 10 further includes neck portion 18 which extends outwardly from soundboard 12 and corresponding side walls 14. Neck portion 18 supports a plurality of strings 20 which extend over fingerboard 22 from head 24 to bridge 26.

Soundboard 12 includes first sound hole 28 having a substantially circular configuration positioned in an upper portion of soundboard 12 below plurality of strings 20 to provide access to the enclosed sound chamber. First sound hole 28 is of conventional design. However, other size and/or geometric shapes could be used for first sound hole 28. Furthermore, multiple sound holes could be used in soundboard 12, if desired. Stringed musical instrument 10 preferably includes second sound hole 30 and third sound hole 32 in the upper portion of soundboard 12 extending through both a portion of soundboard 12, as well as a portion of adjacent side walls 14, and are symmetrically positioned in relation to neck portion 18. The addition of second sound hole 30 and third sound hole 32 alters the internal air column in the enclosed sound chamber and allows sound waves to escape from first sound hole 28, second sound hole 30 and third sound hole 32. This reduces acoustical refraction and deflection of the sound waves within the enclosed sound chamber. Furthermore, the tonal quality and volume of sound emanating from stringed musical instrument 10 is enhanced. Second sound hole 30 and third sound hole 32 are preferably substantially oval in configuration and have substantially the same surface area in both soundboard 12 and side walls 14. However, other sizes and/or geometric shapes could be used for second sound hole 30 and third sound hole 32. Furthermore, additional sound holes extending from soundboard 12 into side walls 14 could be utilized in addition to second sound hole 30 and third sound hole 32. Second sound hole 30 and third sound hole 32 preferably extend up to approximately 50% of the way through the width of side walls 14 at their furthest point of penetration since extending second sound hole 30 and third sound hole 32 greater than approximately 50% through the width of side walls 14 would potentially cause structural integrity concerns in side walls 14. However, it is apparent that second sound hole 30 and third sound hole 32 could have other geometric configurations, could be located at other locations along the perimeter of soundboard 12 and/or could extend greater than approximately 50% through the width of side walls 14, particularly if secondary bracing or some other arrangement is used to alleviate the structural integrity concerns in side walls 14.

Stringed musical instrument 10 further includes a plurality of turnkeys 34 which are provided in head 24 such that each turnkey 34 supports a corresponding string 20 thereon. Turnkeys 34 both hold and tune strings 20.

The configuration and position of second sound hole 30 and third sound hole 32 in stringed musical instrument 10 in accordance with the first preferred embodiment of the present invention provides further advantages over known prior art sound or "f" hole arrangements. In particular, by providing second sound hole 30 and third sound hole 32, in addition to first sound hole 28, which is of conventional design, the directionality of sound emanating from stringed musical instrument 10 is spread out to provide enhanced tonal quality and volume of sound, particularly for those individuals in, for example, an audience in an auditorium who may not be seated in line with first sound hole 28. In addition, second sound hole 30 and third sound hole 32 directs sound from stringed musical instrument 10 to the player to provide feedback and allow the player to make necessary adjustments for tone pitch, tempo and volume of sound emanating from stringed musical instrument 10. Furthermore, second sound hole 30 or third sound hole 32, depending on whether stringed musical instrument 10 is played right or left handed, provides clearance for the fingering hand, particularly when fingering for high notes which brings the player's fingering strings 20 hand into close proximity with soundboard 12 and corresponding side walls 14.

Applicant has found through experimentation that adding second sound hole 30 and third sound hole 32 does not detract from the function of first sound hole 28, which is of conventional design. This conclusion has been reached by noticing the blockage of first sound hole 28 on stringed musical instrument 10 including second sound hole 30 and third sound hole 32 results in a decrease in both tonal quality and volume of sound emanating from stringed musical instrument 10. Thus, it appears as if second sound hole 30 and third sound hole 32 are releasing or taking advantage of sound waves which would otherwise be "lost" through acoustical absorption, cancellation and/or interference within the enclosed sound chamber and would not be released through first sound hole 28.

Figure 3:
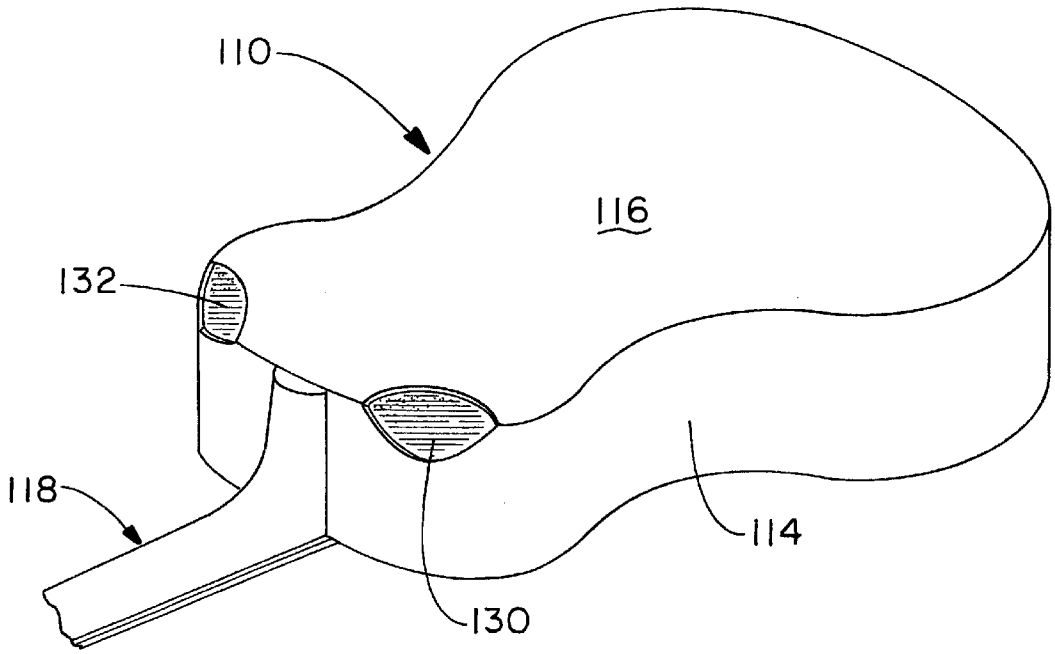
FIG. 3 illustrates a rear perspective view of a stringed musical instrument having three dimensional sound holes in accordance with a second preferred embodiment of the present invention.

Referring now to FIG. 3, a second embodiment of a stringed musical instrument having three dimensional sound holes in accordance with the present invention is shown, identified generally by reference number 110. Stringed musical instrument 110 generally includes top member or soundboard 112, side walls 114 which extend from soundboard 112 at substantially a right angle around the perimeter of soundboard 112 and back member 116 which preferably has substantially the same shape and dimensions as soundboard 112, back member 116 being attached to the surface of side walls 114 distal from soundboard 112 to form an enclosed sound chamber. Stringed musical instrument 110 further includes neck portion 118 which extends outwardly from soundboard 112 and corresponding side walls 114. Neck portion 118 supports a plurality of strings 120 which extend over fingerboard 122 from head 124 to bridge 126.

Soundboard 112 includes first sound hole 128 having a substantially circular configuration positioned in an upper portion of soundboard 112 below plurality of strings 120 to provide access to the enclosed sound chamber. First sound hole 128 is of conventional design. However, other sizes and/or geometric shapes could be used for first sound hole 128. Furthermore, multiple sound holes could be used in soundboard 112, if desired. Stringed musical instrument 110 preferably includes second sound hole 130 and third sound hole 132 in the upper portion of back member 116 extending through both a portion of back member 116, as well as a portion of adjacent side walls 114, and are symmetrically positioned in relation to neck portion 118. The addition of second sound hole 130 and third sound hole 132 alters the internal air column in the enclosed sound chamber and allows sound waves to escape from first sound hole 128, second sound hole 130 and third sound hole 132. This reduces acoustical refraction and deflection of the sound waves within the enclosed sound chamber. Furthermore, the tonal quality and volume of sound emanating from stringed musical instrument 110 is enhanced. Second sound hole 130 and third sound hole 132 are preferably substantially oval in configuration and have substantially the same surface area in both back member 116 and side walls 114. However, other sizes and/or geometric shapes could be used for second sound hole 130 and third sound hole 132. Furthermore, additional sound holes extending from back member 116 into side walls 114 could be utilized in addition to second sound hole 130 and third sound hole 132. Second sound hole 130 and third sound hole 132 preferably extend up to approximately 50% of the way through the width of side walls 114 at their furthest point of penetration since extending second sound hole 130 and third sound hole 132 greater than approximately 50% through the width of side walls 114 would potentially cause structural integrity concerns in side walls 114. However, it is apparent that second sound hole 130 and third sound hole 132 could have other geometric configurations, could be located at other locations along the perimeter of back member 116 and/or could extend greater than approximately 50% through the width of side walls 114, particularly if secondary bracing or some other arrangement is used to alleviate the structural integrity concerns in side walls 114.

Stringed musical instrument 110 further includes a plurality of turnkeys 134 which are provided in head 124 such that each turnkey 134 supports a corresponding string 120 thereon. Turnkeys 34 both hold and tune strings 120.

Figure 4:
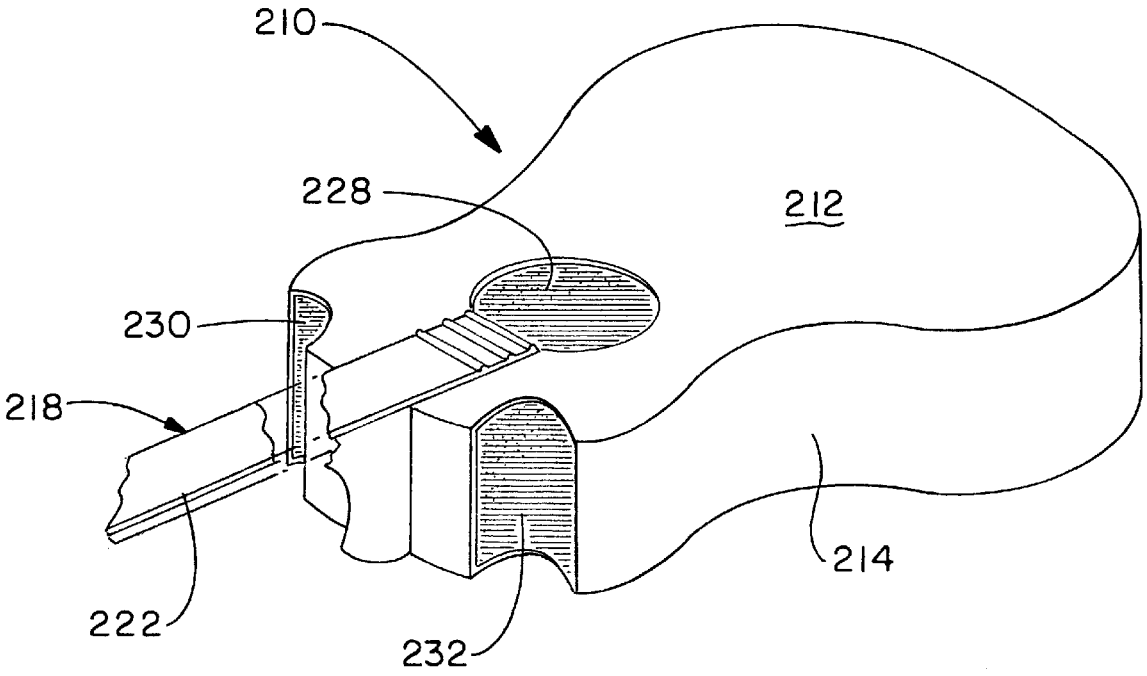
FIG. 4 illustrates a front perspective view of a stringed musical instrument having three dimensional sound holes in accordance with a third preferred embodiment of the present invention.

Referring now to FIG. 4, a third embodiment of a stringed musical instrument having three dimensional sound holes in accordance with the present invention is shown, identified generally by reference number 210. Stringed musical instrument 210 generally includes top member or soundboard 212, side walls 214 which extend from soundboard 212 at substantially a right angle around the perimeter of soundboard 212 and back member 216 which preferably has substantially the same shape and dimensions as soundboard 212, back member 216 being attached to the surface of side walls 214 distal from soundboard 212 to form an enclosed sound chamber. Stringed musical instrument 210 further includes neck portion 218 which extends outwardly from soundboard 212 and corresponding side walls 214. Neck portion 218 supports a plurality of strings 220 which extend over fingerboard 222 from head 224 to bridge 226.

Soundboard 212 includes first sound hole 228 having a substantially circular configuration positioned in an upper portion of soundboard 212 below plurality of strings 220 to provide access to the enclosed sound chamber. First sound hole 228 is of conventional design. However, other sizes and/or geometric shapes could be used for first sound hole 228. Furthermore, multiple sound holes could be used in soundboard 212, if desired. Stringed musical instrument 210 preferably includes second sound hole 230 and third sound hole 232 in the upper portion of soundboard 212 extending through a portion of soundboard 212, through corresponding side walls 214 and through a portion of back member 216, and are symmetrically positioned in relation to neck portion 218. The addition of second sound hole 230 and third sound hole 232 alters the internal air column in the enclosed sound chamber and allows sound waves to escape from first sound hole 228, second sound hole 230 and third sound hole 232. This reduces acoustical refraction and deflection of the sound waves within the enclosed sound chamber. Furthermore, the tonal quality and volume of sound emanating from stringed musical instrument 210 is enhanced. Second sound hole 230 and third sound hole 232 are preferably substantially oval in configuration and have substantially the same surface area in both soundboard 212 and back member 216. However, other sizes and/or geometric shapes could be used for second sound hole 230 and third sound hole 232. Furthermore, additional sound holes extending from soundboard 212, through corresponding side walls 214, into back member 216 could be utilized in addition to second sound hole 230 and third sound hole 232. In addition, secondary bracing or some other arrangement could be used to alleviate the structural integrity concerns in side walls 214 by having second sound hole 230 and third sound hole 232 extend entirely through the width of side walls 214.

Stringed musical instrument 210 further includes a plurality of turnkeys 234 which are provided in head 224 such that each turnkey 234 supports a corresponding string 220 thereon. Turnkeys 234 both hold and tune strings 220.

Although the present invention has been described above in detail, the same is by way of illustration and example only and is not to be taken as a limitation on the present invention. For example, although stringed musical instrument 10 disclosed herein is a guitar, the teachings of the present invention could be readily applied to other stringed musical instruments such as violins, violas, cellos, string basses, mandolins, autoharps, ukuleles, dulcimers and others. Furthermore, although stringed musical instruments 10, 110 and 210 disclosed herein have an enclosed sound chamber formed by side walls 14, 114 and 214 extending substantially at a right angle between soundboard 12, 112 and 212 and back member 16, 116 and 216, having substantially the same shape and dimensions as soundboard 12, 112 and 212, enclosed sound chamber could have other configurations, for example, a parabolic a vaulted or some other type of curved enclosed sound chamber, as is known in the prior art. Accordingly, the scope and content of the present invention are to be defined only by the terms of the appended claims.

What is claimed is:

1. A stringed musical instrument, comprising:

an enclosed sound chamber including a soundboard positioned on a top surface thereof and a side wall downwardly extending from said soundboard; and at least one sound hole positioned on the perimeter of said soundboard, said at least one sound hole extending through both a portion of said soundboard and a portion of said side wall.

2. The stringed musical instrument in accordance with claim 1, wherein said at least one sound hole consists of a first sound hole and a second sound hole, both first sound hole and said second sound hole being positioned on the perimeter of said soundboard and extending through both a portion of said soundboard and a portion of said side wall.

3. The stringed musical instrument in accordance with claim 2, further including a neck portion extending outwardly from said soundboard and said side wall, said first sound hole and said second sound hole being positioned symmetrical in relation to said neck portion.

4. The stringed musical instrument in accordance with claim 3, wherein said first sound hole and said second sound hole are both substantially oval in configuration.

5. The stringed musical instrument in accordance with claim 3, wherein said first sound hole and said second sound hole are both substantially oval in configuration and have substantially the same surface area in both said soundboard and said side wall.

6. The stringed musical instrument in accordance with claim 4, wherein said soundboard further includes a third sound hole in said upper portion of said soundboard, said third sound hole being located entirely in said soundboard.

7. The stringed musical instrument in accordance with claim 6, wherein said third sound hole is substantially circular in configuration.

8. The stringed musical instrument in accordance with claim 2, wherein said first sound hole and said second sound hole both extend through the width of said side wall and into at least a portion of a back member of said enclosed sound chamber.

9. The stringed musical instrument in accordance with claim 2, wherein said soundboard further includes a third sound hole in said upper portion of said soundboard, said third sound hole being located entirely in said soundboard.

10. The stringed musical instrument in accordance with claim 9, wherein said third sound hole is substantially circular in configuration.

11. A guitar, comprising:

a soundboard;

a side wall having a first surface attached to said soundboard, said side wall extending at substantially a right angle around the perimeter of said soundboard and said side wall including a second surface;

a back member having a shape and dimensions substantially similar to said soundboard, said back member attached to said second surface of said side wall, said soundboard, said side wall and said back member forming an enclosed sound chamber for the stringed musical instrument; and at least one sound hole positioned on the perimeter of said back member, said at least one sound hole extending through both a portion of said back member and a portion of said side wall.

12. The stringed musical instrument in accordance with claim 11, wherein said at least one sound hole consists of a first sound hole and a second sound hole, both first sound hole and said second sound hole being positioned on the perimeter of said back member and extending through both a portion of said back member and a portion of said side wall.

13. A guitar, comprising:

a soundboard;

a side wall having a first surface attached to said soundboard, said side wall extending at substantially a right angle around the perimeter of said sound board and said side wall including a second surface;

a back member having a shape and dimensions substantially similar to said soundboard, said back member attached to said second surface of said side wall, said soundboard, said side wall and said back member forming an enclosed sound chamber for the stringed musical instrument; and at least one sound hole positioned on the perimeter of said soundboard, said at least one sound hole extending through both a-portion of said sound board and a portion of said side wall.

14. The guitar in accordance with claim 13, wherein said at least one sound hole consists of a first sound hole and a second sound hole, both first sound hole and said second sound hole being positioned on the perimeter of said soundboard and extending through both a portion of said soundboard and a portion of said side wall.

15. The guitar in accordance with claim 14, further including a neck portion extending outwardly from said soundboard and said side wall, said first sound hole and said second sound hole being positioned symmetrical in relation to said neck portion.

16. The guitar in accordance with claim 15, wherein said first sound hole and said second sound hole are both substantially oval in configuration.

17. The guitar in accordance with claim 15, wherein said first sound hole and said second sound hole are both substantially oval in configuration and have substantially the same surface area in both said soundboard and said side wall.

18. The guitar in accordance with claim 17, wherein said soundboard further includes a third sound hole in said upper portion of said soundboard, said third sound hole being located entirely in said soundboard.

19. The guitar in accordance with claim 18, wherein said third sound hole is substantially circular in configuration.

20. The guitar in accordance with claim 14, wherein said soundboard further includes a third sound hole in said upper portion of said soundboard, said third sound hole being located entirely in said soundboard.

* * * * *